US006017111A

United States Patent [19]

Kurata

[11] Patent Number: 6,017,111

[45] **Date of Patent: *Jan. 25, 2000**

[54] INK JET RECORDING APPARATUS WITH DEVICE FOR EXHAUSTING INK MIST

[75] Inventor: Mitsuru Kurata, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/563,443

[22] Filed: Nov. 28, 1995

[30] Foreign Application Priority Data

Nov. 30, 1994 [JP] Japan ..... 6-297098

[51] Int. Cl.[7] ..... B41J 2/165

[52] U.S. Cl. ..... 347/34

[58] Field of Search ..... 347/34, 104, 102, 347/32, 22, 37; 101/216, 479, 480; 68/12.07

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,580,148 | 4/1986 | Domoto et al. | 347/42 |
| 4,723,129 | 2/1988 | Endo et al. . | |
| 4,740,796 | 4/1988 | Endo et al. . | |
| 4,959,660 | 9/1990 | Suzuki et al. | 347/34 |
| 5,250,121 | 10/1993 | Yamamoto et al. | 106/22 R |
| 5,406,316 | 4/1995 | Schwiebert et al. | 347/34 |

FOREIGN PATENT DOCUMENTS

| | | | |
|---|---|---|---|
| 62-053492 | 3/1987 | Japan . | |
| 3046589 | 7/1991 | Japan . | |
| 405069559 | 3/1993 | Japan | 347/24 |
| 5212851 | 8/1993 | Japan . | |
| 406015832 | 1/1994 | Japan | 347/29 |

*Primary Examiner*—N. Le
*Assistant Examiner*—Thien Tran
*Attorney, Agent, or Firm*—Fitzpatrick, Cella, Harper & Scinto

[57] ABSTRACT

A liquid ejecting apparatus avoids the influence of mist generated by ejection from a liquid ejecting head without reference to the size of the printing width and the duration of the working time. A suction device for removing the ink mist generated and floating in a frame body is connected to the frame body surrounding the maximum scanning range of the liquid ejecting head with the exception of the recording medium side. The suction device includes an exhausting fan for exhausting air from the frame body, pipes for connecting the exhausting fan to the frame body, and a filter disposed at the intermediate part of the pipes.

11 Claims, 6 Drawing Sheets

INK JET RECORDING APPARATUS WITH DEVICE FOR EXHAUSTING INK MIST

BACKGROUND OF THE INVENTION

1. Field of the Invention

The present invention relates to an image forming apparatus for forming an image on a recording medium and more particularly to a liquid ejecting apparatus using a liquid ejecting head for ejecting a liquid (e.g., ink) to a recording medium (printing medium).

2. Description of the Prior Art

An ink jet recording method for performing a printing operation by ejecting ink to a printing medium has been hitherto utilized as a recording method employable for a printer as an output terminal of outputting means for an information processing system, said outputting means including copying machines, facsimiles, electronic typewriters, word processors, work stations or the like, or a handy and/or portable printer which may be equipped in personal computer, host computer, optical disc apparatus, video apparatus or the like.

Since the ink jet recording method is practiced by ejecting ink from a nozzle in the form of fine liquid droplets to record characters, figures or the like, it has excellent advantages as means for outputting an image with high fineness and for performing a printing operation at a high speed. In addition, since a recording apparatus having the foregoing recording method used therefor (hereinafter referred to as an ink jet recording apparatus) is a non-impact type recording apparatus, generates little noise, can easily record images with multi-colors, is constructed with smaller dimensions, and moreover, can record an image with higher density, in recent years, it is rapidly distributed.

Here, the word "recording" involves application of ink to all kinds of ink carriers each adapted to receive ink such as cloth, thread, paper, sheet material or the like. For this reason, the ink jet recording method is applicable not only in the field of information processing but wide industrial fields such as an apparel industry using ink carriers each adapted to receive ink such as cloth, thread, paper, sheet material or the like.

For example, a liquid ejecting apparatus having an ink jet process used therefor (printing and dyeing apparatus) has advantages that a degree of freedom of an image to be printed is high, and the whole printing and dyeing are achieved at a low cost, for a main reason that an original plate for an image to be printed is not required.

With the conventional ink jet recording method, however, ink mist, which has a size smaller than that of ink droplet that is usually called satellite, is generated at the same time when ink droplets to adhere for contributing to printing are ejected during an ejecting operation. The ink mist moves while floating in the air and adheres to parts other than a recording medium.

In case of an apparatus like a small-sized printer which is operated for a short period of working time and has a small total quantity of printing, a quantity of adhesion of the ink mist is very small and causes no serious problem. However, in case of an apparatus having a large print width on the assumption that it is operated for 24 hours per day like an ink jet printing/dyeing apparatus, a large quantity of ink mist adheres to the surrounding and the interior of the apparatus. This is unavoidably recognized as a serious problem.

SUMMARY OF THE INVENTION

Accordingly, an object of the present invention is to provide a liquid ejecting apparatus equipped with means for possibly avoiding the influence of mist generated by ejection of ink from a liquid ejecting head without reference to the size of a print width and a long period of working time.

In the aspect of the present invention, a liquid ejecting apparatus for ejecting liquid to a recording medium by a liquid ejecting head, comprises a frame body surrounding said liquid ejecting head in the closed state with the exception of the side of said recording medium facing to the ejecting port plane of the liquid ejecting head as viewed from the liquid ejecting head; and sucking means for sucking air from the frame body.

Here, the frame body may include opening portions for connecting the frame body to the sucking means, and the opening portions are connected to an exhaust pipe for communicating with the sucking means.

The exhaust pipe may include a filter at the intermediate part of the exhaust pipes, the filter collecting mist of the liquid contained in air within said frame body, and venting the remaining air from which the mist is removed.

The liquid ejecting apparatus may further comprise means for scanning the liquid ejecting head, the frame body surrounding the whole scanning range of the liquid ejecting head.

The opening portions of said frame body may be disposed in the vicinity of the opposite ends of the scanning range of the liquid ejecting head.

The sucking means may generate suction force larger than compression force caused in the frame body by displacement of the liquid ejecting head scanned by the scanning means.

The frame body may include a cover member which is openable.

Here, the cover member may be turnably displaced about an axis rectangular to the scanning direction of the scanning means. The cover member may be dividable into a plurality of parts.

The liquid ejecting head may include a thermal energy transducer for generating thermal energy to be given to the liquid, as energy generating means for ejecting the liquid.

Here, the thermal energy transducer may be an electric thermal transducer.

The recording medium may be a cloth.

According to the present invention, since the liquid ejecting apparatus includes a frame body surrounding the liquid ejecting head and sucking means connected to the frame body, mist generated from either of serial type and line type printing heads can effectively be collected, and a quantity of the mist adhering to other part rather than the recording medium can be reduced.

In addition, since a filter is disposed in the suction passage of the sucking means, mist contained in air in the frame body can effectively be collected, and the air having the mist removed therefrom can be exhausted to the outside in the vicinity of the liquid ejecting apparatus and associated apparatuses.

Further, according to the present invention, since cover members are arranged on the frame body, a maintenance operation for maintaining the interior of the liquid ejecting apparatus can easily be achieved.

The above and other effects, features and advantages of the present invention will become more apparent from the following description of the embodiments thereof taken in conjunction with the accompanying drawings.

BRIEF DESCRIPTION OF THE DRAWING

FIG. 5A and FIG. 5B are views which explain a maintenance operation for the printing/dyeing apparatus shown in FIGS. 1 to 4, wherein FIG. 5A shows the state before the maintenance operation, and FIG. 5B shows the state during the maintenance operation.

DESCRIPTION THE PREFERRED EMBODIMENTS

The present invention will be described in detail hereinafter with reference to the accompanying drawings which illustrate preferred embodiments thereof.

First Embodiment (1) Structure of the Whole Apparatus

Figures 1A, 1B:
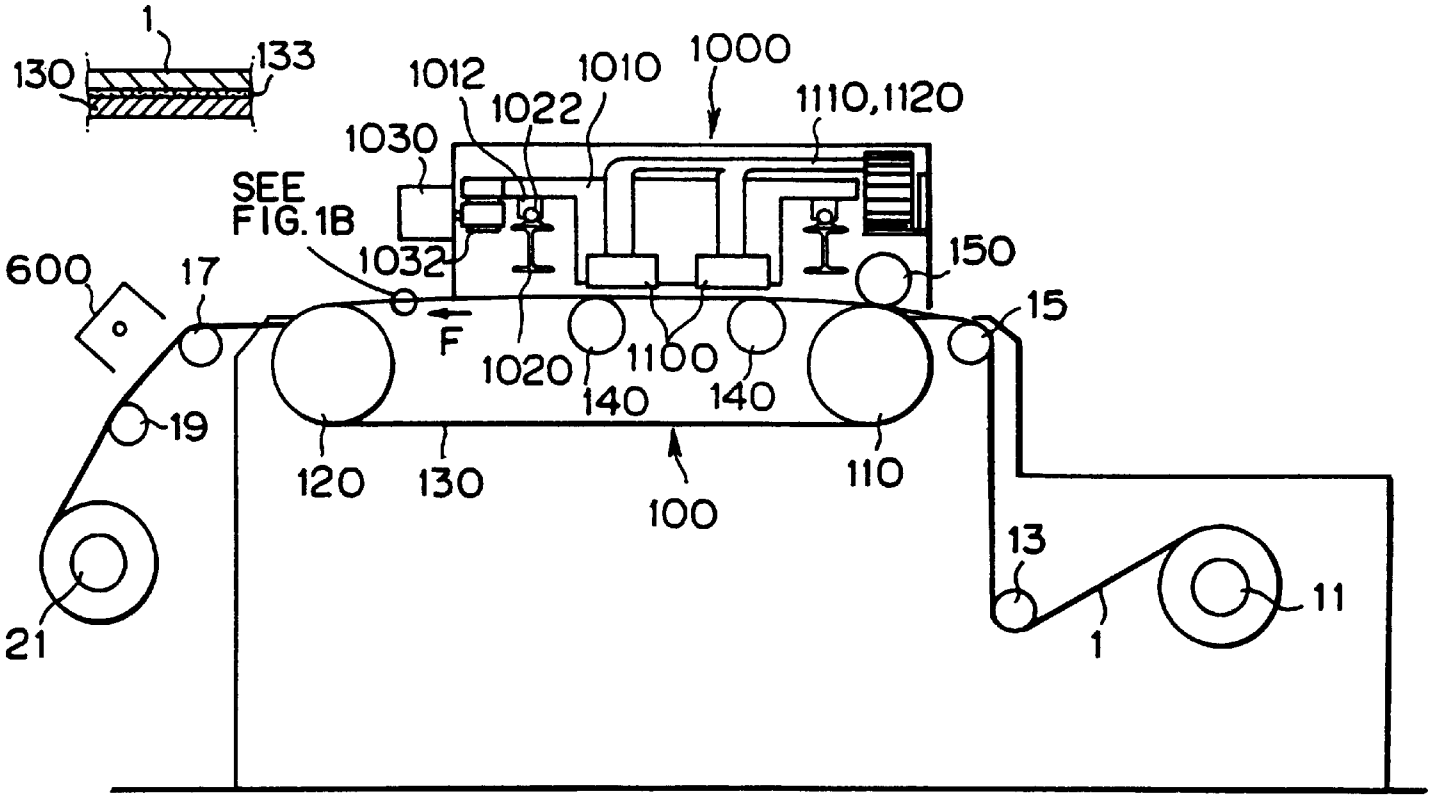
FIG. 1A is a schematic sectional view showing the structure of a printing/dyeing apparatus as an embodiment of a liquid ejecting apparatus according to the present invention.
FIG. 1B is an enlarged, cross-sectional view of the conveying belt of the apparatus shown in FIG. 1A.

The structure of a printing/dyeing apparatus as example of a liquid ejecting apparatus constructed according to the present invention is shown in FIG. 1A. In the drawing, reference numeral 1 denotes a cloth serving as a recording medium (printing medium). As an unwinding roll 11 is rotated, the cloth 1 is unwound from the unwinding roller 11. The cloth 1 is conveyed via intermediate rollers 13 and 15 in the substantially horizontal direction by conveying section 100 located opposite to a printer section 1000, and thereafter, it is wound by a winding roller 21 via a feeding roller 17 and an intermediate roller 19.

The conveying section 100 includes conveying rollers 110 and 120, an endless type conveying belt 130, and a pair of platen rollers 140 for expanding a predetermined range of the conveying belt 130 with an adequate intensity of tension to hold the surface of a cloth to be printed in the improved flatness at a time of a printing operation. In this embodiment, a metallic conveying belt as disclosed in Japanese Patent Laid-Open Publication No. 212851/1993 is used for the conveying belt 130, and as partially enlargely shown in FIG. 1B, a tacky layer (sheet) 133 is placed on the surface of the metallic conveying belt 130. The cloth 1 adheres to the tacky layer 133 with the aid of an adhering roller 150 to maintain a flatness of the cloth during the printing operation.

As the cloth 1 is conveyed while maintaining its flatness, a printing agent is applied to the cloth 1 within the range between the platen rollers 140, and subsequently, the cloth 1 is peeled away from the tacky layer 133 at the position of the conveying roller 120 and it is then wound by the winding roller 21. In the course of the winding operation, the cloth 1 is subjected to drying by a drying heater 600.

Incidentally, an adequate type of heater such as a heater for blowing hot air to the cloth 1 or a heater for irradiating infrared rays to the cloth 1 is employable for the drying heater 600.

(2) Construction of the Printer Section

Figure 2:
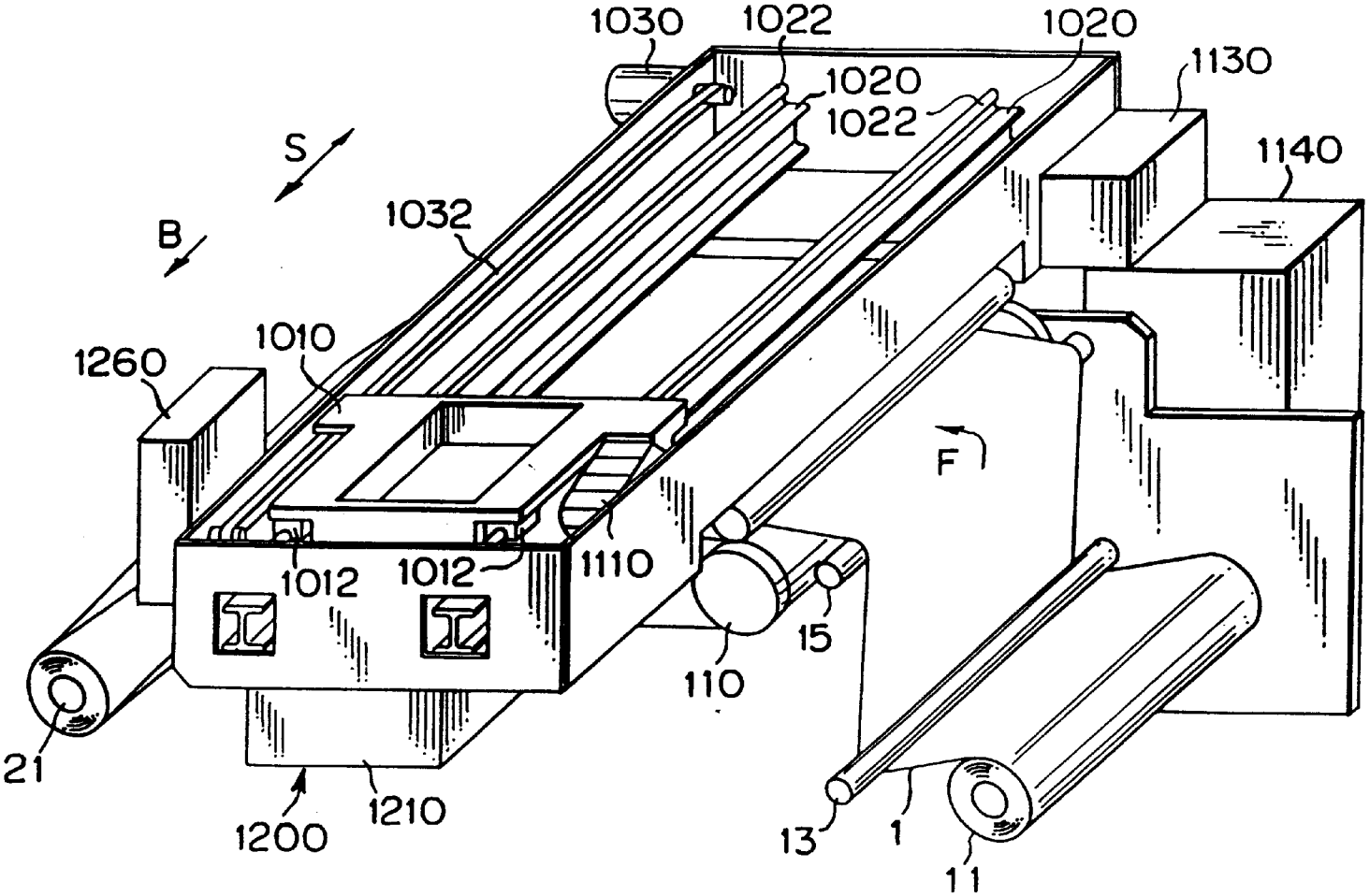
FIG. 2 is an enlarged perspective view of essential part of the printing/dyeing apparatus shown in FIG. 1.
Figure 3:
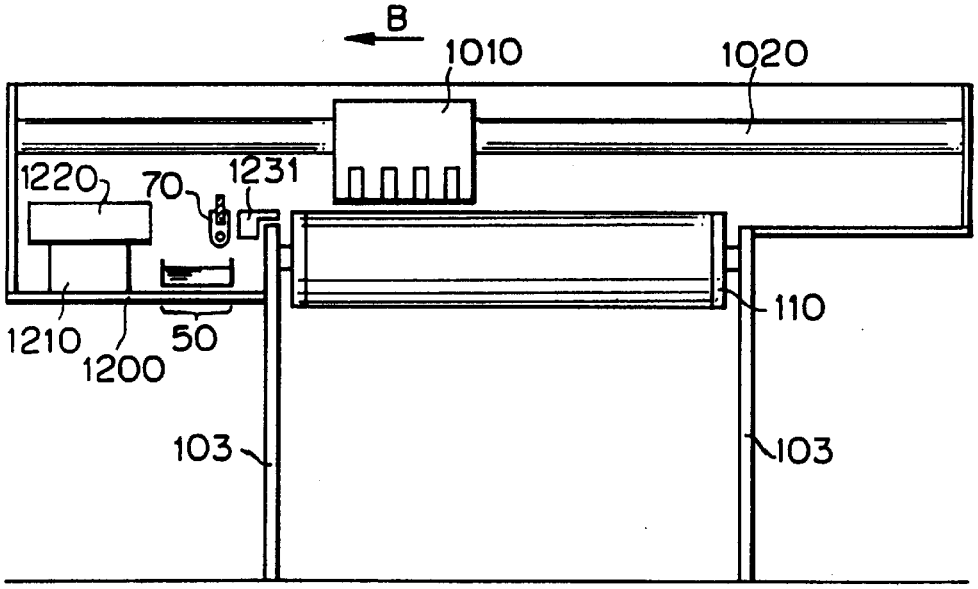
FIG. 3 is a front view of the essential part of the printing/dyeing apparatus as viewed in the conveying direction of a recording medium.

FIG. 2 is a perspective view which schematically shows the printer section 1000 and the conveying system for the cloth 1, and FIG. 3 is a sectional view of a scanning system of a carriage. The construction of the printer section 1000 will be explained with reference to FIGS. 1, 2 and 3.

First, in FIGS. 1 and 2, the printer section 1000 includes a carriage 1010 adapted to be scanned in a different direction from the conveying direction of the cloth (auxiliary scanning direction), e.g., an S arrow-marked direction of the cloth rectangular to the conveying direction. Reference numeral 1020 denotes support rails extending in the S arrow-marked direction (main scanning direction) which support sliders 1012 fixedly secured to the carriage 1010. Reference numeral 1030 denotes a motor serving as a driving power source for performing main scanning with the carriage 1010. The driving force of the motor 1030 is transmitted to the carriage 1010 via suitable power transmitting mechanism including a belt 1032.

The carriage 1010 includes a plurality of printing heads 1100 having a number of printing agent applying elements arranged in a predetermined direction (in this embodiment, in the conveying direction F) in the direction different from the predetermined direction (in this embodiment, in the main scanning direction S), and in this embodiment, the printing heads 1100 are arranged at two stages in the conveying direction. In each stage, a plurality of printing heads 1100 are arranged corresponding to printing agents each having a different color, whereby color printing can be achieved. The number of colors of the printing agents and the number of the printing heads are suitably selected corresponding to an image to be formed on the cloth 1. For example, yellow (Y), magenta (M) and cyan (C) that are three initial colors of printing and/or black (Bk) are selected. In place of these colors or together with them, special colors (metallic color such as gold color, silver color or the like, fresh red and blue), which are impossible or difficult to be visually expressed with the three initial colors can be used. Otherwise, a plurality of printing agents may be used corresponding to density even though a color to be used is same.

In this embodiment, as shown in FIG. 1, a plurality of printing heads 1100 arranged in the main scanning direction S are arranged at two stages in the conveying direction F. Colors of the printing agents, the number of arrangement of the printing agents, and the order of arrangement of the printing agents used at each stage may be same at each stage corresponding to an image to be printed, or they may be different at each stage. In addition, the range which is printed by main scanning performed by the printing heads at one stage can be printed again by printing heads at next stage (printing may be performed by printing heads at each stage in the complementarily extracted state or in the superimposed state). High speed printing can be performed while the printing range is allocated to each printing stage. Further, the number of stages of the printing heads should not be limited only to two. Alternatively, it may be one stage or three or more stages.

In this embodiment, an ink jet head, i.e., a bubble jet head which is proposed by Canon Co., Ltd. and includes a heat generating element for generating thermal energy for causing a phenomenon of film boiling to appear in ink, e.g., as energy to be utilized for ejecting ink, is used as an ink jet head for the printing head 1100. Here, the heat generating element may be an electric thermal transducer for transducing an electric signal into thermal energy. Ink ejecting ports each serving as a printing agent applying element are used with downward attitude for the cloth 1 conveyed in the substantially horizontal direction by the conveying section 100 so that ink is ejected under uniform conditions without any water head difference among respective ejecting ports, whereby it is possible to form a good image, and moreover, it is possible that uniform recovering treatment is conducted for all the ejecting ports.

In FIG. 3, capping means 1220 comes in contact with an ejecting port plane of each printing head 1100 while no printing operation is performed in order to suppress drying of the ejecting port plane and invasion of foreign materials or to obviate the foregoing malfunction. Specifically, while no printing operation is performed, the printing head 1100 is displaced to the position facing to the capping means 1220. The capping means 1220 is driven in the capping direction by the driving means 1210 to perform capping by allowing an elastic member or the like to come in pressure contact with the ejecting port plane.

Clogging preventing means 1231 receives the ejected ink when the printing head 1100 performs an ejecting operation (preliminary ejecting operation) for making ejecting conditions uniform on ink refreshing. This clogging preventing means 1231 is disposed at the position facing to the printing head outside of the printing range of the printing head and includes liquid receiving members for receiving and absorbing the preliminarily ejected ink at the position between the capping means 1220 and the printing range as well as the opposite side to the foregoing position. It should be noted that a liquid holding member is disposed in each liquid receiving member, and a sponge-like porous member is used as a material for the liquid holding member.

Wiping means or wiping blade 70 adapted to come in slidable contact with the ejecting port plane of the printing head is disposed between the capping means 1220 and the printing range to wipe water droplets and dust adhering to the ejecting port plane by such slidable contact.

Reference numeral 1130 denotes ink feeding means which serves to feed ink to each printing head 1100. Reference numeral 1110 denotes a guide member for an ink tube for delivering ink from the ink feeding means 1130 to each printing head 1100. Reference numeral 1140 denotes ink supplementing means for successively supplementing ink to the ink feeding means.

Figure 4:
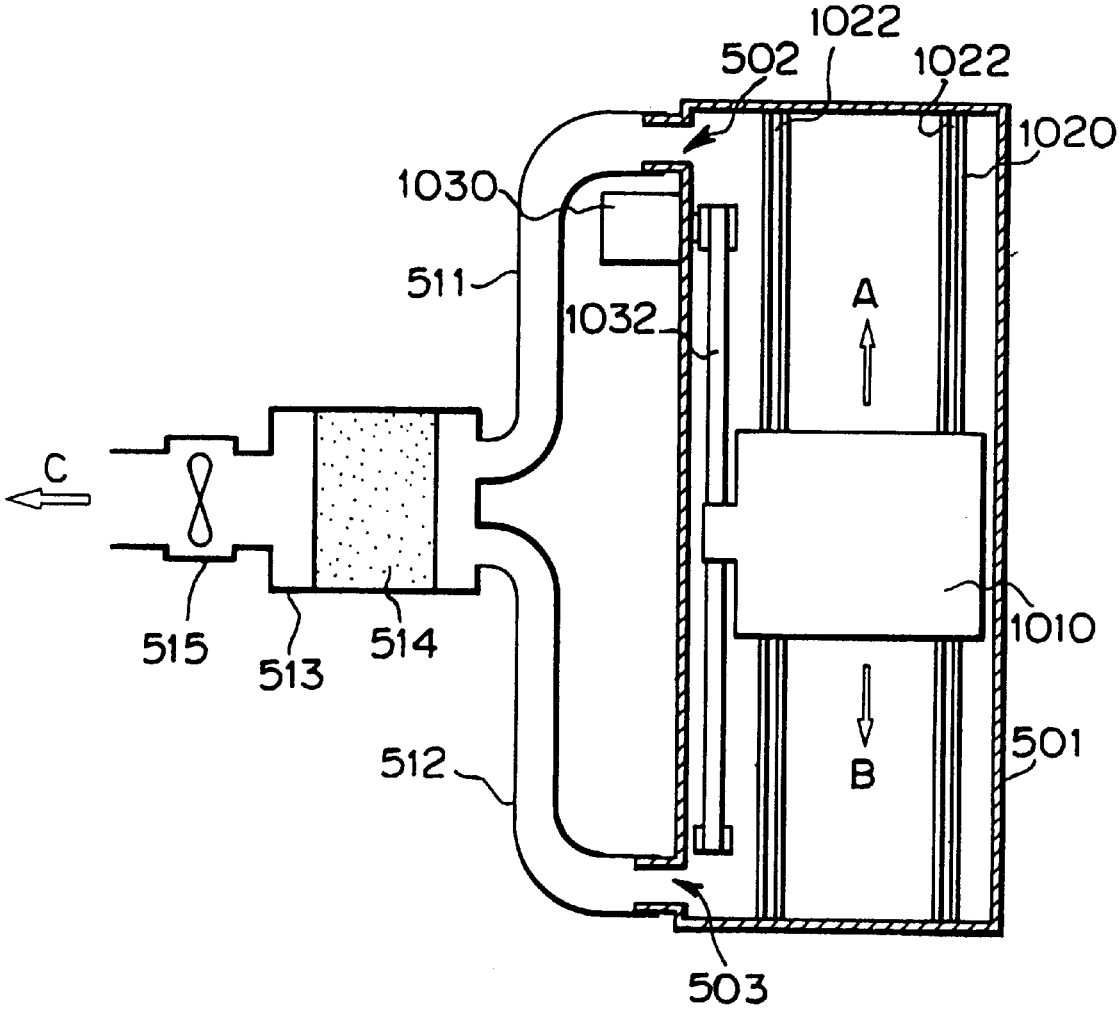
FIG. 4 is a plan view showing the relationship between a frame and sucking means in the essential part of the printing/dyeing apparatus shown in FIG. 2.

FIG. 4 is an enlarged sectional view showing an essential part in this embodiment. In FIG. 4, reference numeral 501 denotes a frame body which is formed along the outer periphery of the scanning portion of the head carriage. The frame body 501 surrounds the substantially whole part of the scanning range of the carriage with the exception of the recording medium 1 side to hold the peripheral part of the carriage in the substantially closed state.

The frame body 501 is formed with opening portions 502 and 503 in the vicinity of the side surface of the scanning range of the carriage, one end of each of exhausting pipes 511 and 512 are connected to the opening portions 502 and 503. The other ends of the exhaust pipes 511 and 512 are connected to a filter box 513. The filter box 513 includes a filter member 514 for removing ink mist from the air sucked therein. A fan 515 is disposed for the filter box 513 so as to exhaust the sucked air to the outside in the C arrow-marked direction. When the carriage 1010 is scanned in the A arrow-marked direction, air in the upper space of the frame body 501 as viewed in FIG. 4 is compressed by the carriage 1010. When the carriage 1010 is scanned in the B arrow-marked direction air in the lower space of the frame body 501 is compressed by the carriage 1010. The influence of the compression force cannot be neglected as the size of the frame body 501 becomes approximate to the size of the scanning range of the carriage more and more. For this reason, suction operation can excellently be performed by preliminarily setting a quantity of air suction from both the opening portions 502 and 503 to a value larger than the quantity of air compression. Thus, air containing the ink mist in the frame body 501 can quickly be sucked even though there are some gaps and openings in the frame body 501 with the result that leakage of the ink mist to the outside of the frame body 501 can be prevented.

Consequently, according to this embodiment, scattering of the ink mist to the outside of the closure can be completely prevented, and moreover, it is possible to recover a large part of ink mist in the interior of the frame body.

In this embodiment, a filtering member 514 is disposed between the exhaust pipes 511 and 512 and the exhausting fan 515, but it is not necessarily disposed in the liquid ejecting apparatus of this embodiment. Alternatively, it is acceptable that another mist treatment unit is disposed outside of the liquid ejecting apparatus of this embodiment so as to allow air containing mist to be exhausted to this treatment unit.

Next, description will be made with respect to maintenance operations for the interior of the printer and so forth.

In this embodiment, the cloth 1 is substantially conveyed in the horizontal direction, ink jet type printing heads 1100 are arranged with their ejecting ports oriented in the downward direction, and the printer section 1000 is located directly above the conveying section 100. In this embodiment, the printer section 1000 is supported by side plates 103 of the conveying section 100.

On the other hand, there arises an occasion that replacement of the worn conveying belt or associated components with new ones and maintenance operations for repairing, cleaning or the like of components due to damage, injury, contamination of the like are required, and to perform replacing operations and repairing operations, cleaning operations or the like, it is required to open the conveying section 100. Prior to opening the conveying section 100, the printer section 1000 should be removed. Removal of the printer section 1000 upon each and every maintenance operation is not desirable, because screws or similar fitting members must be disconnected, the printer section has large size and weight, and a gap between the ejecting ports and cloth 1 (hereinafter referred to as a head gap) must be readjusted after completion of the maintenance operation.

In view of the foregoing fact, this problem is solved by allowing the printer section 1000 and the conveying section 100 to be relatively displaced toward and away from each other by a simple operation.

Figure 5A:
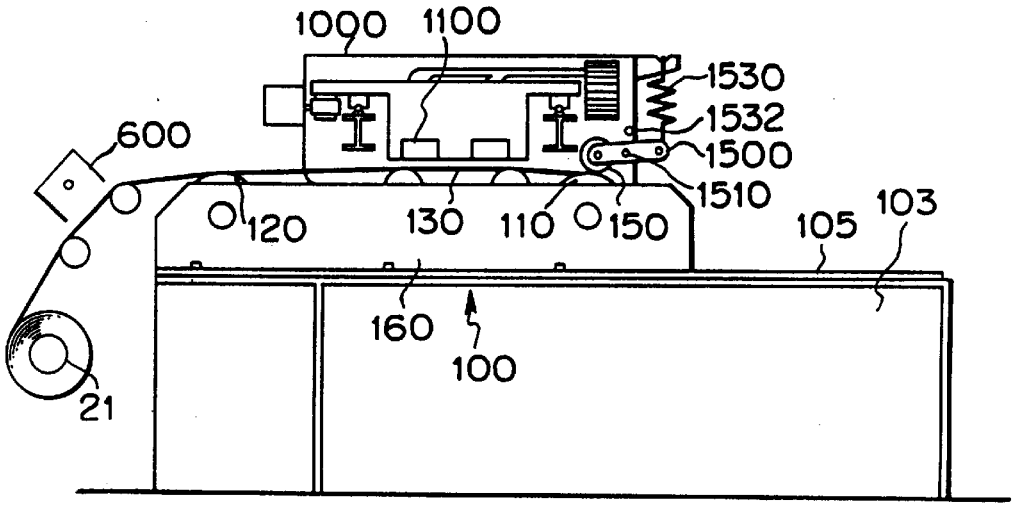
Figure 5B:
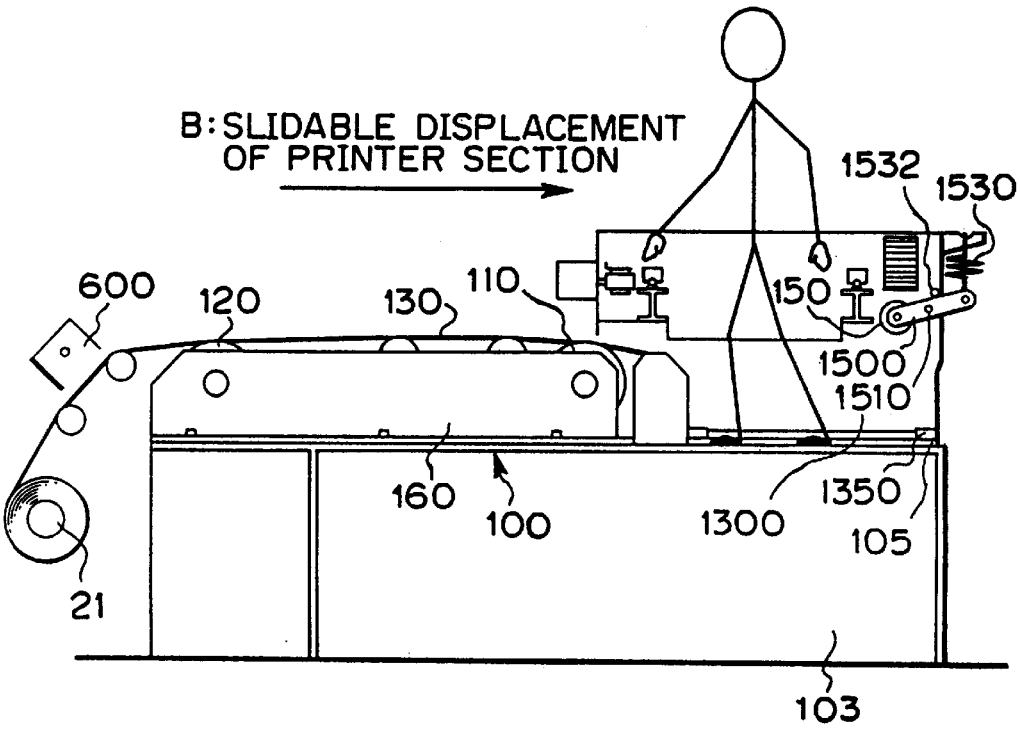

FIGS. 5A and 5B are schematic sectional views showing by way of example the structure and operations to be performed for the foregoing object. FIG. 5A shows the state prior to the maintenance operation, and FIG. 5B shows the state in the course of the maintenance operation.

In this embodiment, slide rails 105 are arranged on both the side plates 103 of the conveying section 100, and sliders 1350 (slide bushes) are fitted to a printer stand 1300 of the printer section 1000 to be engaged with the slide rails 105. That is, the printer section 1000 is supported on the side plates 103 of the conveying section 100 via the slide rails 105 and the sliders 1350.

When the conveying section 100 is opened, the printer section 1000 is slidably displaced in the B arrow-marked direction so that the interior of the conveying section 100 is exposed to the outside as shown in FIG. 5B, enabling a desired maintenance operation to be performed. On completion of the maintenance operation, it is sufficient that the printer section 1000 is returned to the position as shown in FIG. 5A. It is recommendable that a suitable locking mechanism is disposed so as not to allow the printer section 1000 to be slidably displaced at the normal printing operation (FIG. 5A) as well as at the escape position (FIG. 5B).

Specifically, in this embodiment, since it is sufficient that the printer section 1000 is slidably displaced when a maintenance operation is performed for the conveying section 100 even though the printer section 1000 has comparatively large size and weight like the printing/dyeing apparatus of this embodiment, it is not required that the printer section 1000 is removed and returned upon each maintenance operation.

When an operator enters the interior of the printer to perform a maintenance operation, it is preferable that an upper part of the frame body 501 is separately prepared in the form of covers so as to easily turnably open them.

Figure 6:
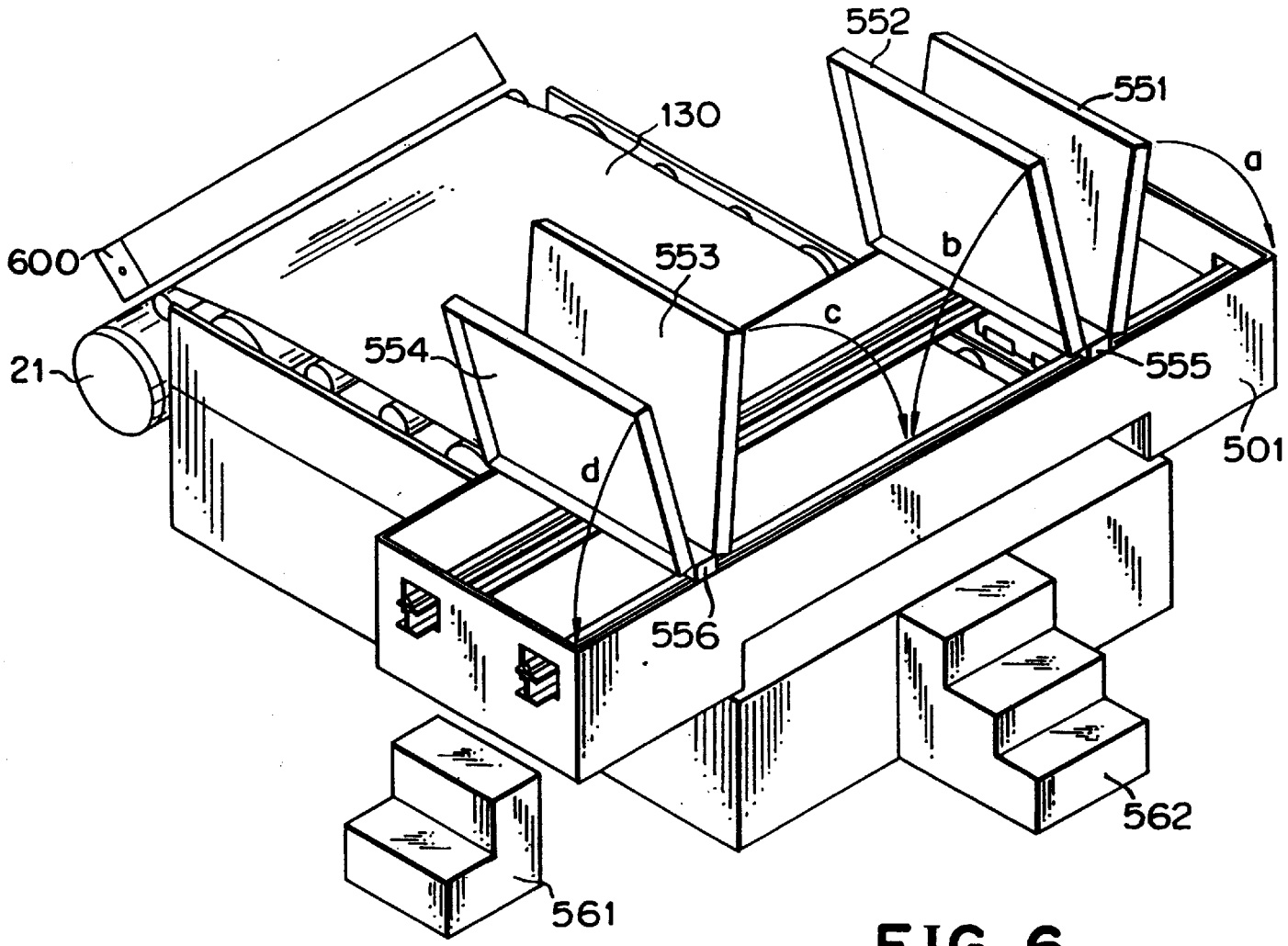
FIG. 6 is a perspective view which shows the structure of cover members turnably secured to a frame body of the printing/dyeing apparatus shown in FIGS. 1 to 4.

FIG. 6 is a perspective view which shows by way of example turnable opening and closing of the covers. Reference numerals 551 to 554 denote covers each serving as a cover member. The covers 551 to 554 are turnably (turnable in the a to d arrow-marked directions) secured to support shafts 555 and 556 extending at a right angle relative to a pair of support rails 1020 serving as main scanning rails via hinge plates (not shown). It is recommendable that a suitable locking mechanism is disposed so as to allow the doors to be unintentionally turnably closed at the opened positions.

When a maintenance operation is performed at the opposite ends of the carriage scanning range as shown in FIG. 6, an operator rises, e.g., along a step 561 and opens the cover 554 to perform a maintenance operation for the interior of the printer. With respect to the central part of the frame body 501, he rises along the step 502 and opens the cover 552 and 553 to perform a maintenance operation for the interior of the printer. In some cases, it is possible to perform a maintenance operation while an operator enters the printer as shown in FIG. 5B. Since the covers 552 and 553 can be turnably opened in the direction at a right angle relative to the support rails 1020, e.g., a correcting operation for the cloth 1 on the conveying belt 130 can be achieved without any particular problem, because the covers 552 and 553 are turnably opened in the opposite directions.

In this embodiment, description has been made with respect to a liquid ejecting apparatus including a serial type liquid ejecting head which performs a recording operation by reciprocable displacement relative to the cloth 1, but it goes without saying that the present invention is equally applicable in the case of a liquid ejecting apparatus including a line type liquid ejecting head having the substantially same width as that of the cloth 1.

Subsequently, the description will be made of the entire processes of the ink jet textile printing. After the ink jet textile printing process is executed by the use of the above-mentioned ink jet printing apparatus, the textile is dried (including natural drying). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For these dispersion and reactive fixation processes, conventionally known methods can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.
(2) Dye fixation factor is high for ink.
(3) Ink must be dried quickly.
(4) The generation of irregular ink spread is limited.
(5) Feeding can be conducted in an excellent condition in an apparatus.

In order to satisfy these requirements, it may be possible to give a preparatory treatment to the textile used for printing as required. In this respect, the textile having an ink receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tri-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethyl cellulose; polysaccharide such as sodium alginate, gum arabic, locust bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3COONa$ and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table cloths, and the like are obtained. As the methods of machine stitch to make clothes and other daily needs, a widely known method can be used.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying ink droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assembly, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, and an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

As described above, according to the present invention, the following advantageous effects are obtainable.

(1) A frame body surrounding the liquid ejecting head in the substantially closed state and sucking means connected to the frame body are arranged for a liquid ejecting apparatus for ejecting predetermined liquid to a recording medium by using a liquid ejecting head, scattering of mist of the liquid to the outside of the frame body can be completely prevented, and moreover, a large part of mist in the interior of the frame body can be recovered.

(2) By disposing a filter in the suction passage of sucking means, mist can effectively be removed from the air sucked from the interior of the frame body, and air can be exhausted from the sucking means in the proximity of the liquid ejecting apparatus. Thus, the liquid ejecting apparatus can be constructed in a simplified manner.

(3) Since the upper part of the frame body is separately formed as covers which are turnably opened about the shaft extending at a right angle relative to the scanning direction of the carriage of the liquid ejecting apparatus, the interior and the exterior of the liquid ejecting apparatus can easily be maintained.

The present invention has been described in detail with respect to preferred embodiments thereof, and it will now be understood that changes and modifications may be made without departure from the invention in its broader aspect, and it is the intention, therefore, in the appended claims to cover all such changes and modifications as fall within the true spirit of the invention.

What is claimed is:

1. A liquid ejecting apparatus for ejecting liquid to a recording medium by a liquid ejecting head to perform recording on the recording medium, said apparatus comprising:

a carriage for reciprocally scanning the liquid ejecting head along a recording surface of the recording medium in a reciprocal scanning range;

a frame body accommodating a space to reciprocally scan said carriage without avoiding directly facing the liquid ejecting head to the recording medium, the space including reciprocal scanning spaces being defined by said carriage and said frame body at front and rear portions of said carriage in a direction for moving said carriage, each volume of the reciprocal scanning spaces being increased or decreased in accordance with the reciprocal scanning of said carriage; and ports arranged at each end side of said frame body, with each end side being at opposite ends of the reciprocal scanning range of said carriage, each of said ports communicating one of said reciprocal scanning spaces in said frame body with an outside of said frame body, wherein a substance constituting atmosphere within said reciprocal scanning spaces is exhausted through said ports to the outside of said frame body when each volume of said reciprocal scanning spaces is decreased.

2. A liquid ejecting apparatus as claimed in claim 1, further comprising suction means disposed outside of said frame body and an exhaust pipe for communicating said ports with said suction means.

3. A liquid ejecting apparatus as claimed in claim 2, wherein said exhaust pipe includes a filter at an intermediate part of said exhaust pipe, said filter collecting mist of the liquid contained in the atmosphere within said frame body, and venting the atmosphere from which the mist is removed.

4. A liquid ejecting apparatus as claimed in claim 1, further comprising means for scanning said carriage.

5. A liquid ejecting apparatus as claimed in claim 1, further comprising suction means for generating a suction force larger than a compression force caused in said frame body when each volume of said reciprocal scanning spaces is decreased.

6. A liquid ejecting apparatus as claimed in claim 1, wherein said frame body comprises an openable cover member.

7. A liquid ejecting apparatus as claimed in claim 6, wherein said cover member is turnably displaced about an axis transverse to the scanning direction of said carriage.

8. A liquid ejecting apparatus as claimed in claim 7, wherein said cover member comprises a plurality of cover member sections.

9. A liquid ejecting apparatus as claimed in claim 1, wherein said liquid ejecting head comprises a thermal energy transducer for generating thermal energy applied to the liquid for ejecting the liquid.

10. A liquid ejecting apparatus as claimed in claim 9, wherein said thermal energy transducer comprises an electrothermal transducer.

11. A liquid ejecting apparatus as claimed in claim 1, wherein the recording medium comprises a cloth.

* * * * *

UNITED STATES PATENT AND TRADEMARK OFFICE

CERTIFICATE OF CORRECTION

PATENT NO. : 6,017,111

DATED : January 25, 2000

INVENTOR(S) : KURATA

It is certified that error appears in the above-identified patent and that said Letters Patent is hereby corrected as shown below:

On the title page, item

[56] References:

FOREIGN PATENT DOCUMENTS, "3046589" should read --3-46589--, and "5212851" should read --5-212851--.

COLUMN 1:

Line 55, "case" should read --the case--.

Line 59, "case" should read --the case--.

COLUMN 2:

Line 8, "to" should be deleted.

Line 45, "of" should be deleted.

Line 47, "part" should read --parts--.

COLUMN 3:

Line 3, "of" (first occurrence) should read --of an--.

Line 48, "enlargely" should read --enlargedly--.

COLUMN 4:

Line 31, "color" should read --colors--.

Line 41, "arrangement" should read --arrangements--.

COLUMN 5:

Line 10, "to" (second occurrence) should be deleted.

Line 19, "to" should be deleted.

UNITED STATES PATENT AND TRADEMARK OFFICE

CERTIFICATE OF CORRECTION

PATENT NO. : 6,017,111

DATED : January 25, 2000

INVENTOR(S) : KURATA

It is certified that error appears in the above-identified patent and that said Letters Patent is hereby corrected as shown below:

COLUMN 6:

Line 32, "of" should read --or--.

COLUMN 8:

Line 15, "are" should read --is--.
Line 28, "salt" should read --salts--.
Line 39, "polysaccharide" should read --polysaccharides–.
Line 42, "polymer" should read --polymers--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*